US008113680B2

(12) United States Patent
O'Brien et al.

(10) Patent No.: US 8,113,680 B2
(45) Date of Patent: Feb. 14, 2012

(54) LIGHT FIXTURE WITH DIRECTED LED LIGHT

(75) Inventors: Aaron O'Brien, Chicago, IL (US); Oleg Petryuchenko, Chicago, IL (US)

(73) Assignee: Lightology, LLC, Chicago, IL (US)

( * ) Notice: Subject to any disclaimer, the term of this patent is extended or adjusted under 35 U.S.C. 154(b) by 347 days.

(21) Appl. No.: 12/435,795

(22) Filed: May 5, 2009

(65) Prior Publication Data

US 2010/0284181 A1 Nov. 11, 2010

(51) Int. Cl.
*F21S 8/00* (2006.01)

(52) U.S. Cl. ..... 362/147; 362/241; 362/298; 362/346

(58) Field of Classification Search ..... 362/147, 362/241, 243, 247, 249.02, 297, 298, 346, 362/348
See application file for complete search history.

(56) References Cited

U.S. PATENT DOCUMENTS 5,199,782 A * 4/1993 Johnson et al. ..... 362/147
6,474,852 B1 * 11/2002 Ohkohdo et al. ..... 362/346
7,217,009 B2 5/2007 Klose
7,281,818 B2 10/2007 You et al.
7,578,600 B2 * 8/2009 Czajkowski ..... 362/243
2008/0204888 A1 * 8/2008 Kan et al. ..... 362/297
2010/0085760 A1 * 4/2010 Hsu et al. ..... 362/241

OTHER PUBLICATIONS

"line™ 2.0 Symmetric", io Lighting, 2007 (2 pages).
"iW Cast 14 Powercore", Philips Solid-State Lighting Solutions, Color Kinetics (4 pages).

* cited by examiner

*Primary Examiner* — Y My Quach Lee
(74) *Attorney, Agent, or Firm* — Wood, Phillips, Katz, Clark & Mortimer

(57) ABSTRACT

A light fixture for lighting a wall, including a supporting base and at least one light emitting diode (LED) on the base emitting light in a cone having a central axis. A first reflector is curved between a first lip secured to the base adjacent the LED and a second lip spaced from the base, with the central axis of the cone intersecting the first reflector between the first and second lips. A second reflector defines a reflecting enclosure for and includes first and second generally flat surfaces on opposite sides of the LED and substantially symmetrical about a plane which includes the light cone central axis, and a third generally flat surface intersecting both of the first and second surfaces, whereby the first reflector is oriented to reflect light from both the LED and the second reflector in a beam having a selected shape.

24 Claims, 12 Drawing Sheets

Fig. 7
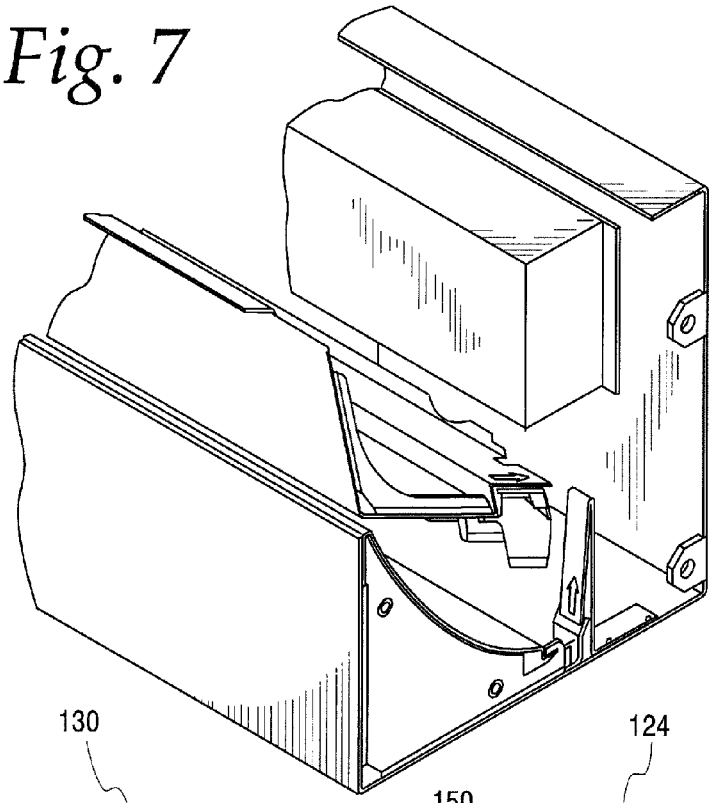
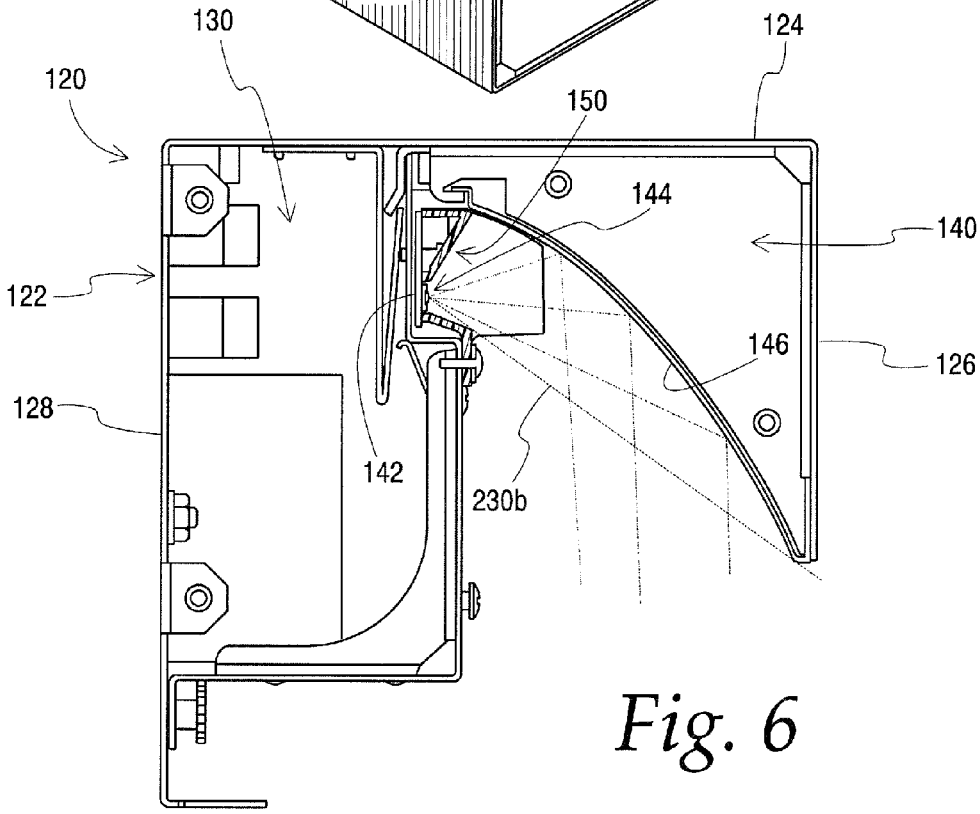
Fig. 6

LIGHT FIXTURE WITH DIRECTED LED LIGHT

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward light fixtures, and particularly toward light fixtures which direct light from light emitting diodes (LEDs).

BACKGROUND OF THE INVENTION AND TECHNICAL PROBLEMS POSED BY THE PRIOR ART

Light fixtures are, of course, used for a variety of purposes. Beyond simply providing light to enable people to see better, fixtures are also sometimes used for architectural and design purposes, for example to highlight features to provide a desired aesthetic appearance.

For example, in some structures it is desirable to create a large visual hot spot or high point of illumination to draw attention to that area. Accent lighting is used for such purposes.

Wall grazing fixtures, by contrast, are used for different architectural and design purposes, with the light from the fixtures intended to light walls, most effectively textured and three-dimensional surfaces. When used indoors, such fixtures make a room feel brighter because the vertical light levels along the wall lead one to believe that the overall light levels have been increased, and also can add a sense of space. When used outdoors, such fixtures light surfaces to highlight features (e.g., accent the texture of a structure's walls) to impact the overall appearance of the structure to persons passing by.

Whatever the purpose of the lighting, effective lighting will preferably have the light reliably and efficiently directed to provide the desired lighting.

For example, effective wall grazing fixtures will distribute light along the height of the wall, with uniformity of illumination desired between the lowest and highest vertical areas of the wall, which uniformity is hard to define and difficult to achieve. Rather than create large high points such as provided by accent lighting, light from wall grazing fixtures may hit the edges of often multiple textures protruding from the wall to highlight the textures and surfaces, with the effect being to draw attention to large surface areas and the contrast created between the dark areas at the low points and the highlighted areas of the protruding shapes. This is true for both indoor and outdoor applications.

The key to accomplishing the end effect is to create a beam of light which is focused within a narrow beam with the light directed mostly parallel with the wall. Having a wide beam also eases the ability to uniformly light the wall with varying fixture spacing.

Prior art fixtures designed for wall grazing applications (including Kim Lighting's the Wall Director and Commander, IO Lighting's Line, Color Kinetics and Neo Ray's Series 76) use either reflectors or refractors to direct the light away from the light source towards a wall.

For example, Kim Lighting uses reflectors to maximize light from a single ended light source which puts out light in 360 degrees, mainly perpendicular to the axis, with either end of the light source along the main axis emitting little or no light. The lamp is positioned with the main distribution directed through an aperture, without reflection, in a manner to light the intended target, with reflectors parallel with the central axis of the lamp to help lighting efficiency. Further, putting the lamp perpendicular to the wall will distribute light in the farthest direction along a wall (direct light being the most efficient).

Reflectors have also been used to reflect light from the lamp opposite the aperture, as well as to reflect the light which is cut off because it would be considered glare or light pollution, particularly with a high intensity light source and short linear arc tube.

Fluorescent fixtures have used a still different method. The source still emits light in a 360 degree distribution perpendicular to the main axis like a high intensity arc source, though the length of the source is much longer which means that the lamp will perform best when mounted parallel to the wall. Like high intensity sources, light needs to be directed through an aperture towards a wall, requiring that light emitting away from the aperture must be reflected back through the aperture, with light which is cut off to prevent glare and light pollution also reflected to improve efficiency. However, with the 360 degree output of fluorescent fixtures, it is difficult to distribute the light efficiently through the aperture. This results in lost light or large areas of high illumination and large areas of poor light, undesirably creating an uneven lighting wherein only half of the wall is only lit well.

In either of the above scenarios, the optical efficiency ranges between 65 and 80 percent, meaning that 20 percent or more of the light generated is lost before leaving the light fixture.

Light emitting diodes (LEDs) have also been used in light fixtures, such as shown in U.S. Pat. Nos. 7,217,009 and 7,281,818, and by IO Lighting and ColorKinetics. An LED typically emits light in a cone shaped beam (often 120 degrees, generally similar to an incandescent reflector lamp). When such beams are projected with the axis parallel with the wall, the cone shape of distribution can be seen (referred to as a scallop), although scallops can be made to disappear as the cones of light overlap each other if multiple LEDs are used in close proximity.

Further, to improve the amount of light directed parallel with the wall (i.e., to reduce the amount of light which is inefficiently lost as a result of travelling away from the wall to be illuminated), a refractive optic has also been used on the output side of such LEDs. This can, for example, tighten the beam distribution (as measured from Nadir) to 10 degrees (versus, e.g., 120 degrees) if desired (while optics may be used to spread or tighten the distribution, if the desired effect is to get more light further down the wall, using an optic to tighten the beam would be the proper choice).

As previously mentioned, when a cone of light is directed parallel to a wall, the cone of light becomes visible as it is reflected off of the target surface. While theoretically putting LEDs close together could help in causing scalloping from the multiple cones to disappear, how close together LEDs can be placed is limited by the size of any refractive optic used to tighten the beam. As a result, when using individual refractive optics for each LED, it is difficult to light a wall without creating some type of scallop.

To overcome the scalloping problem, a secondary optic has been used to create a lateral distribution which reduces scalloping, but such secondary refractive optic increases cost and lessens efficiency. That is, if the refractive optic is linear and continuous along the center line of multiple LED's (and perpendicular to the axis of the LED distribution), there will be better uniformity so that the cones of light will not be noticeable, but the lateral distribution of the LED will still be, for example, 120 degrees. However, while the 120 degree beam may be suitable for distribution, it does not throw as much light down the wall as the aforementioned system with the individual refractive optics.

The present invention is directed toward overcoming one or more of the problems set forth above.

SUMMARY OF THE INVENTION

In one aspect of the present invention, a light fixture for lighting a wall is provided, including a supporting base and at least one light emitting diode (LED) on the base emitting light in a cone having a central axis. A first reflector is curved between a first lip secured to the base adjacent the LED and a second lip spaced from the base, with the central axis of the cone intersecting the first reflector between the first and second lips. A second reflector defines a reflecting enclosure for and includes first and second generally flat surfaces on opposite sides of the LED and substantially symmetrical about a plane which includes the light cone central axis, and a third generally flat surface intersecting both of the first and second surfaces, whereby the first reflector is oriented to reflect light from both the LED and the second reflector in a beam having a selected shape.

In one form of this aspect of the invention, the base is adapted for mounting whereby the beam is directed at a wall to provide selected lighting of the wall.

In another form of this aspect of the invention, the surfaces of the second reflector are highly reflective matte white.

In still another form of this aspect of the invention, the first and second surfaces of the second reflector include upper edges restricting direct light of the light cones escaping the enclosures to less than about 45 degrees on either side of the central axes in the linear plane.

In yet another form of this aspect of the invention, the curved first reflector is generally parabolic to direct light from the fixture in a beam having a spread of less than about 10 degrees.

In another form of this aspect of the invention, the light enclosure further includes a fourth generally flat surface on the opposite side of the axis from the third surface and intersecting both of the first and second surfaces, where the third and fourth generally flat surfaces cooperate to direct light asymmetrically relative to the cone axes from the enclosures to the first reflector. In a further form, the curved first reflector is generally parabolic to direct light from the fixture in a beam having a spread of less than about 10 degrees.

In another aspect of the present invention, a light fixture for lighting a wall is provided, including a supporting base adapted to mount adjacent the wall and a plurality of linearly aligned LEDs on the base. Each LED emits light in a cone, and the base is adapted to be mounted whereby each of the cones has a central axis oriented substantially perpendicular to the wall. A linearly extending first reflector is curved between a first linear lip secured to the base adjacent the LEDs and a second lip spaced from the base, with the central axes of the cones intersecting the first reflector between the first and second lips. A linearly extending second reflector defines a plurality of reflecting enclosures with each of the LEDs in separate reflecting enclosures. Each reflecting enclosure includes first and second generally flat surfaces on opposite sides of the LED and substantially symmetrical about a plane which includes the light cone central axis of the associated LED and is perpendicular to the linear direction, and a third generally flat surface extending in the linear direction and intersecting both of the first and second surfaces. The first reflector is oriented to reflect light from the LEDS and the second reflector in a substantially narrow beam along the linear direction of the fixture.

In one form of this aspect of the invention, the base is adapted for mounting to the wall with the second lip adjacent the wall.

In another form of this aspect of the invention, the first reflector is glossy metal.

In still another form of this aspect of the invention, the surfaces of the second reflector are highly reflective matte white.

In still another form of this aspect of the invention, the first and second surfaces of the second reflector include upper edges restricting direct light of the light cones escaping the enclosures to less than about 45 degrees on either side of the central axes in the linear plane.

In yet another form of this aspect of the invention, the light cones have apexes generally centered on the LEDs, the third surfaces of the second reflector have generally linear aligned upper edges between the LEDs and the first reflector, and a plane including the apexes of the light cones and the linear aligned edges of the third surfaces intersects the first reflector generally adjacent and parallel to the second lip. In a further form, the first and second surfaces of the second reflector include upper edges restricting direct light of the light cones escaping the enclosures to less than about 45 degrees on either side of the central axes in the linear plane.

In another form of this aspect of the invention, the base includes an electrical enclosure.

In still another form of this aspect of the invention, the curved first reflector is generally parabolic to direct light from the fixture in a beam having a 8 to 10 degree spread, the beam having a substantially uniform spread across the linear direction.

In yet another form of this aspect of the invention, the light enclosures each also include a fourth generally flat surface extending in the linear direction and intersecting both of the first and second surfaces, the third and fourth flat surfaces cooperating to direct light asymmetrically relative to the cone axes from the enclosures to the first reflector.

In still another aspect of the present invention, a light fixture for providing light to graze a wall is provided, including a supporting base adapted to mount adjacent the wall and a plurality of linearly aligned LEDs on the base. Each LED emits light in a cone, with each of the cones having a central axis oriented substantially perpendicular to the wall when the base is mounted adjacent the wall. A linearly extending first reflector is substantially parabolic between a first linear lip secured to the base adjacent the LEDs and a second lip spaced from the base, with the central axes of the cones intersecting the first reflector between the first and second lips. The first reflector adjacent the second lip is oriented with its surface generally parallel to the wall when the base is mounted adjacent the wall. A linearly extending second reflector defines a plurality of reflecting enclosures with each of the LEDs in separate reflecting enclosures. Each reflecting enclosure includes first and second generally flat surfaces on opposite sides of the LED and substantially symmetrical about a plane which includes the light cone central axis of the associated LED and is perpendicular to the linear direction, and a third generally flat surface extending in the linear direction and intersecting both of the first and second surfaces. The first reflector is oriented to reflect light from the LEDS and the second reflector in a direction which substantially grazes the wall.

In one form of this aspect of the invention, the base is adapted for mounting to the wall with the second lip adjacent the wall.

In another form of this aspect of the invention, the first reflector is glossy metal.

In still another form of this aspect of the invention, the surfaces of the second reflector are highly reflective matte white.

In yet another form of this aspect of the invention, the light cones have apexes generally centered on the LEDs, the third surfaces of the second reflector have generally linear aligned upper edges between the LEDs and the first reflector, and a plane including the apexes of the light cones and the linear aligned edges of the third surfaces intersects the first reflector generally adjacent and parallel to the second lip.

In still another form of this aspect of the invention, the first and second surfaces of the second reflector include upper edges restricting direct light of the light cones escaping the enclosures to less than about 45 degrees on either side of the central axes in the linear plane.

In another form of this aspect of the invention, the base includes an electrical enclosure.

In still another form of this aspect of the invention, the curved first reflector is generally parabolic to direct light from the fixture in a beam having a 8 to 10 degree spread, the beam having a substantially uniform spread across the linear direction.

In yet another form of this aspect of the invention, the light enclosures each also include a fourth generally flat surface extending in the linear direction and intersecting both of the first and second surfaces, the third and fourth flat surfaces cooperating to direct light asymmetrically from the enclosures to the first reflector.

BRIEF DESCRIPTION OF THE DRAWINGS

FIG. 6 is a side cross-sectional view of the fixture of FIG. 5;

FIG. 7 is a partially broken away perspective view of one end of the fixture of FIG. 5;

DETAILED DESCRIPTION OF THE INVENTION

Figure 1:
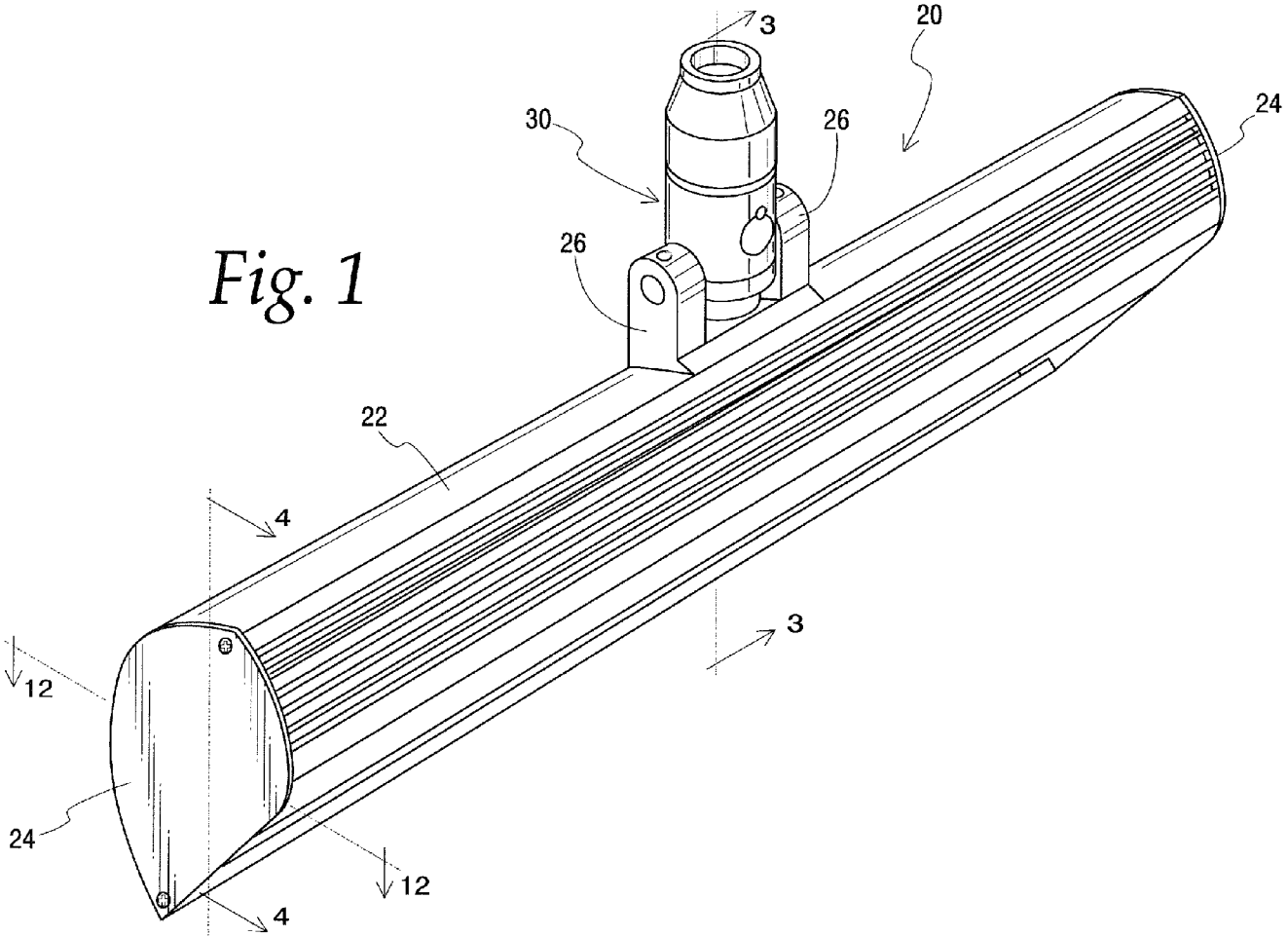
FIG. 1 is a perspective view of a first embodiment of a light fixture according to the present invention.

FIGS. 1-4 illustrate one light fixture 20 which incorporates at least some features of the present invention. As seen in FIG. 1, the fixture 20 includes a base or housing 22 with side plates or covers 24. Brackets 26 on the housing 22 are suitably secured to a support 30, whereby the entire fixture 20 may be supported by securement of the support 30 to a ceiling, for example. As further described below, the support 30 may allow for remote adjustment of the position (orientation) of the fixture 20 to provide the desired lighting from the fixture 20.

Figure 2:
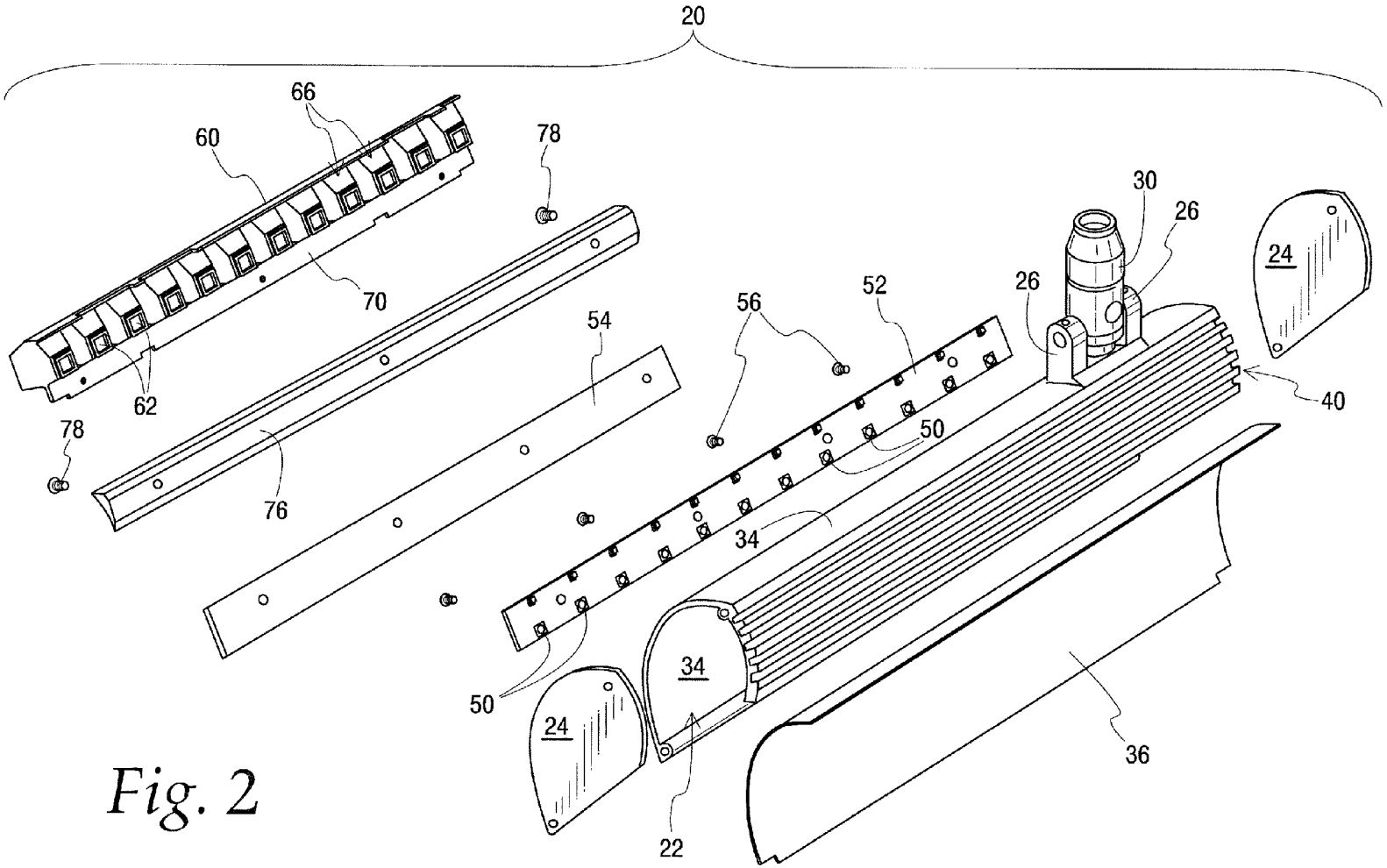
FIG. 2 is an exploded view of the fixture of FIG. 1.

FIG. 2 further illustrates, in an exploded view, the major components of and in the housing 22.

Specifically, the housing 22 itself extends linearly to form a semi-tubular shape with an opening along its length through which light is emitted.

A first, generally parabolic, portion 34 of the housing 22 encloses a first reflector 36 which also extends linearly and has a generally parabolic shape. The first reflector 36 is preferably made of, or coated by, a suitable reflective material to maximize light output and minimize light loss. For example, the first reflector 36 may be made of a glossy metal providing a mirror type optical effect. The parabolic housing portion 34 is advantageously used for a variety of reasons, including protecting the first reflector 36, helping to support the parabolic housing portion 34 in the proper orientation, and to provide the desired aesthetic outer appearance (and it should be appreciated that the housing portion 34 could, if desired, be a different shape than parabolic for aesthetic reasons).

A second, base, portion 40 of the housing 22 is adjacent the parabolic housing portion 34, and generally supports the mounting of the light generating and emitting portions of the fixture 20. This portion may include suitable cooling ribs 42, to facilitate cooling of heat generated by the light generating components.

The light from the fixture is generated by a plurality of light emitting diodes (LEDs) 50 which may advantageously be evenly spaced along a line on a suitable circuit board 52. Suitable power and light lines (not shown) are provided to control the LEDs, which lines may, for example, be strung through openings in the support 30 and/or brackets 26 to both protect the lines as well as for aesthetic reasons. It should be understood, however, that the provision of power and control of the LEDs 50 may be accomplished in any suitable manner within the scope of the present invention.

An electric insulator 54 may also be located between the circuit board 52 and the housing base portion 40 to, for example, electrically insulate the circuit board 52 from the housing 22, and improve contact between. The insulator 54 may also, or alternatively, act as a heat conductor to facilitate the transfer of heat from the circuit board 52 to the housing base portion 40, so that heat will be most advantageously transferred to the cooling ribs 42 for cooling of the fixture 20 generally. Suitable fasteners such as screws 56 may be used to secure the circuit board 52 to the housing base portion 40 with the heat conduit 54 therebetween (see FIG. 3).

A linearly extending second reflector 60 is secured over the circuit board 52, and includes openings 62 aligned with the LEDs 50. The second reflector 60 defines a plurality of reflecting enclosures 66 with each of the LEDs 50 in separate reflecting enclosures 66. The second reflector 60 is described in further detail below.

The second reflector 60 also may advantageously include a flange 70 along one side, which flange is securable to a longitudinal shoulder 72 (see FIG. 3) inside the housing base portion 40. A reinforcing strip 76 may advantageously be secured over the flange 70 and secured to the shoulder 72 by a suitable fastener such as screws 78 to securely position the second reflector 60 within the housing 22 relative to the LEDs 50. If desired, the reinforcing strip 76 may also include a face 80 which defines a portion of the reflecting enclosures 66 and provides a reliably positioned lip 82 which helps to ensure that direct light does not undesirably leak from the fixture 20.

Figure 3:
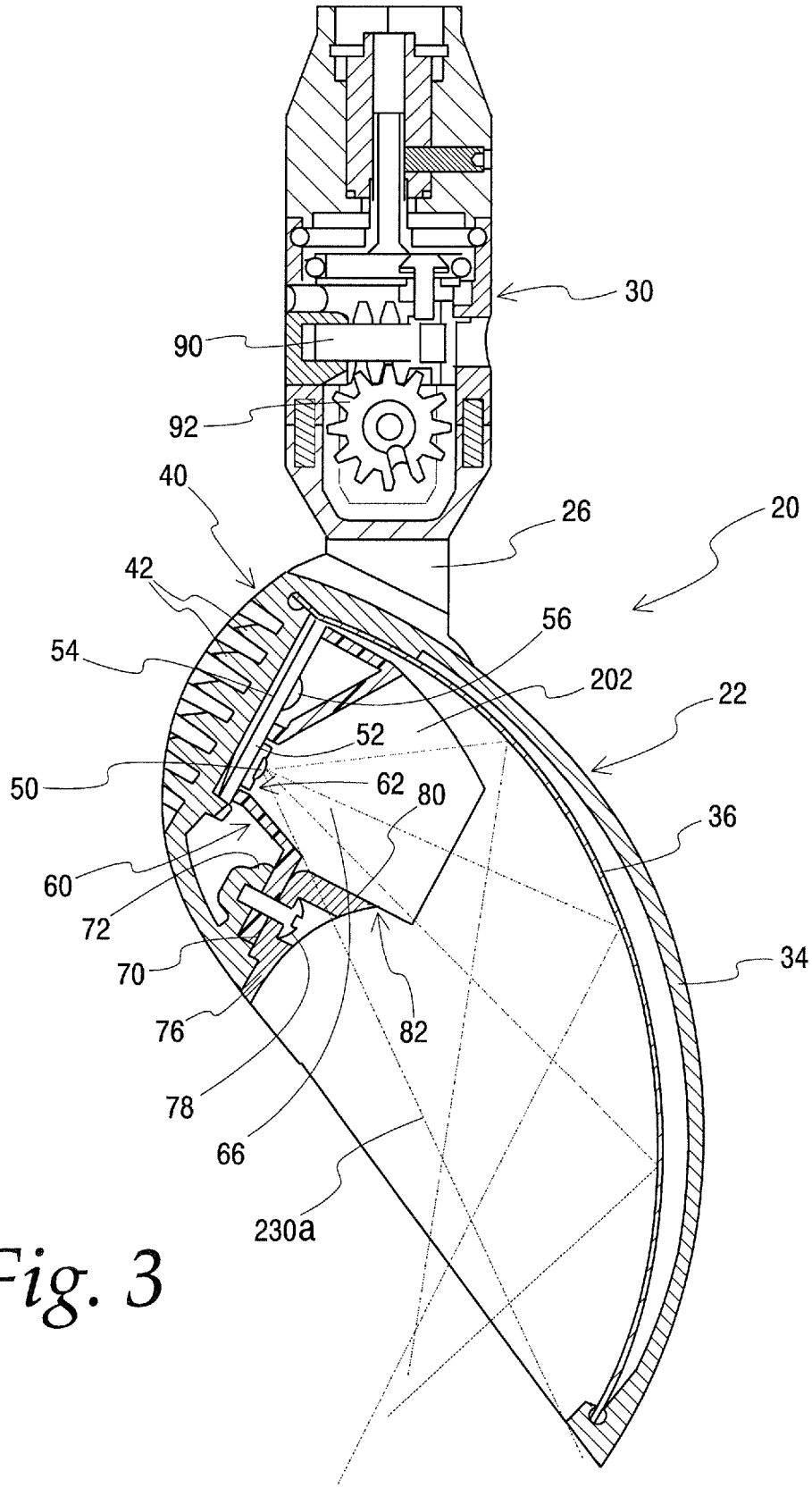
FIG. 3 is a side cross-sectional view of the fixture of FIG. 1 taken through the supporting arm along line 3-3 of FIG. 1.
Figure 4:
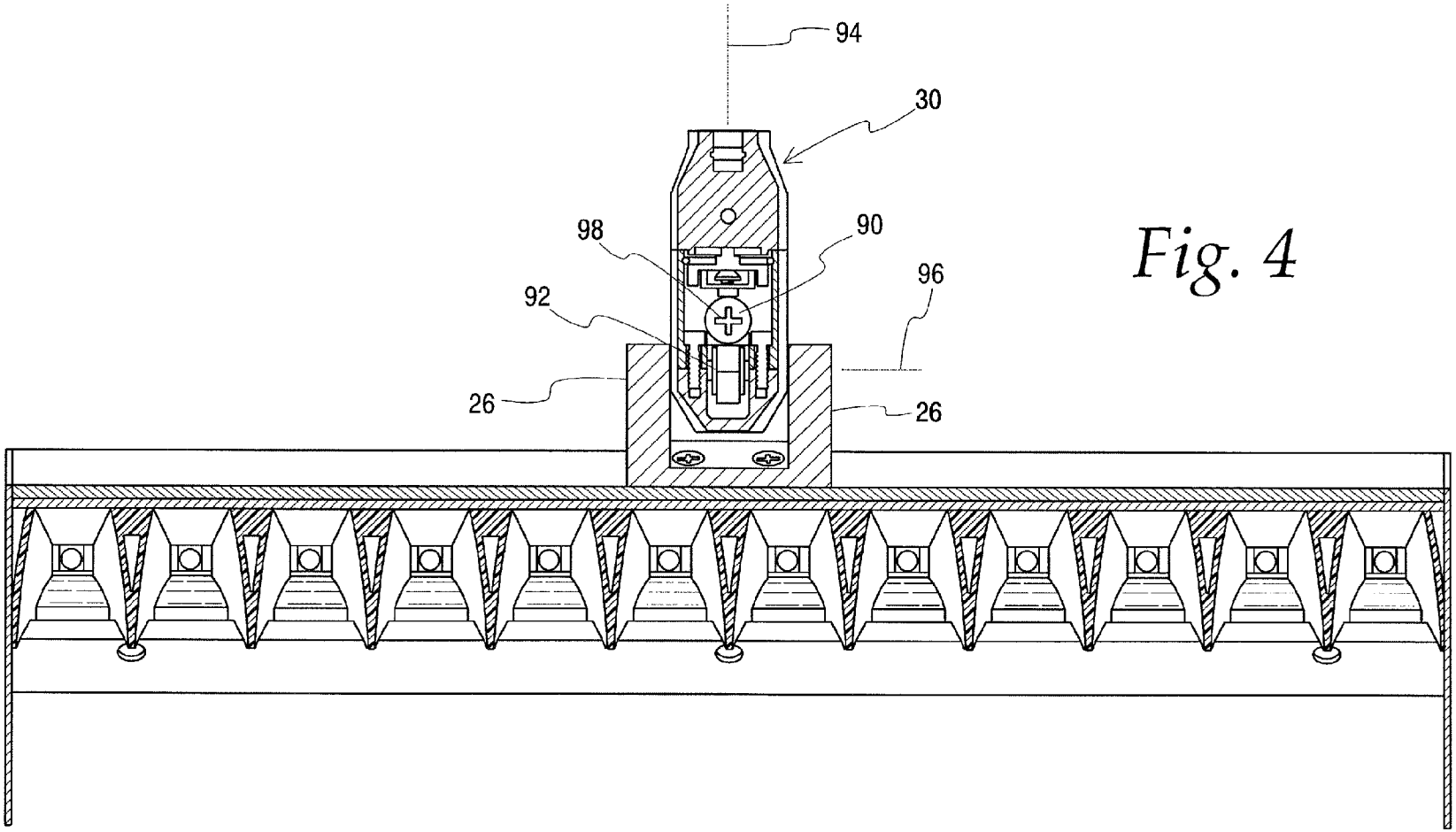
FIG. 4 is a face cross-sectional view of the fixture of FIG. 1 also taken through the supporting arm, taken along line 4-4 of FIG. 1.
Figure 5:
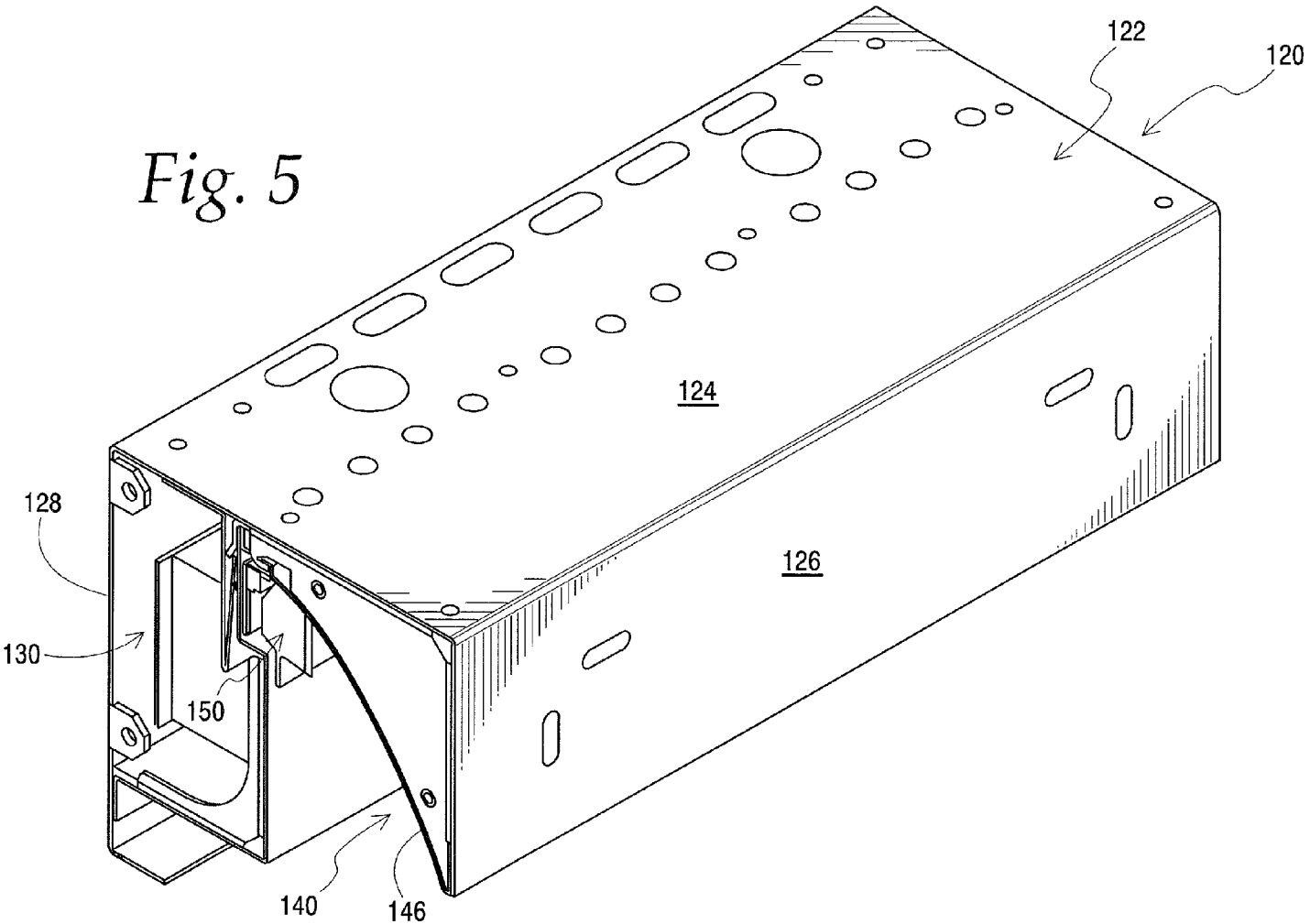
FIG. 5 is a perspective view of a second embodiment of a wall grazing light fixture according to the present invention.

As illustrated in FIGS. 3-4, the support 30 may include a suitable drive mechanism including a worm 90 and gear 92 which may be driven to rotate the support around its central axis 94 and/or around the axis 96 of the connection to the brackets 26, to permit the housing 22 to be positioned as required for the particular installation, and also to permit adjustment after initial installation. Control of the drive mechanism of the support 30 may be accomplished in any suitable manner, including, for example, a motor drive, or a manual drive which may be manipulated by a screwdriver (e.g., engaging a Phillips-head opening 98 in a head secured to the worm 90).

It should be appreciated that the light fixture 20 of FIGS. 1-4 may be used to form a beam of light in a desired configuration to provide selected lighting, such as wall washing, FIGS. 5-9 illustrate an alternate embodiment of a light fixture 120 which may be advantageously mounted directly to, or behind, a surface such as a ceiling for specific wall grazing of the light. In this embodiment, the housing 122 may have a generally rectangular cross-section, with a flat horizontal wall 124 and flat side walls 126, 128, and may be formed of any suitable material, such as bent sheet metal. Suitable holes may be provided in the walls 124, 126, 128, for example, for mounting screws and/or electrical wiring.

An electrical component chamber 130 may be advantageously provided on one side of the housing 122 to provide space for desired electrical components to control and power the lights.

Adjacent the component chamber 130 is a reflecting portion 140. A circuit board 142 with spaced LEDs 144, a first, parabolic, reflector 146, and a second, linearly extending, reflector 150 are also provided, similar to the fixture 20 of FIGS. 1-4 described above.

Figure 8:
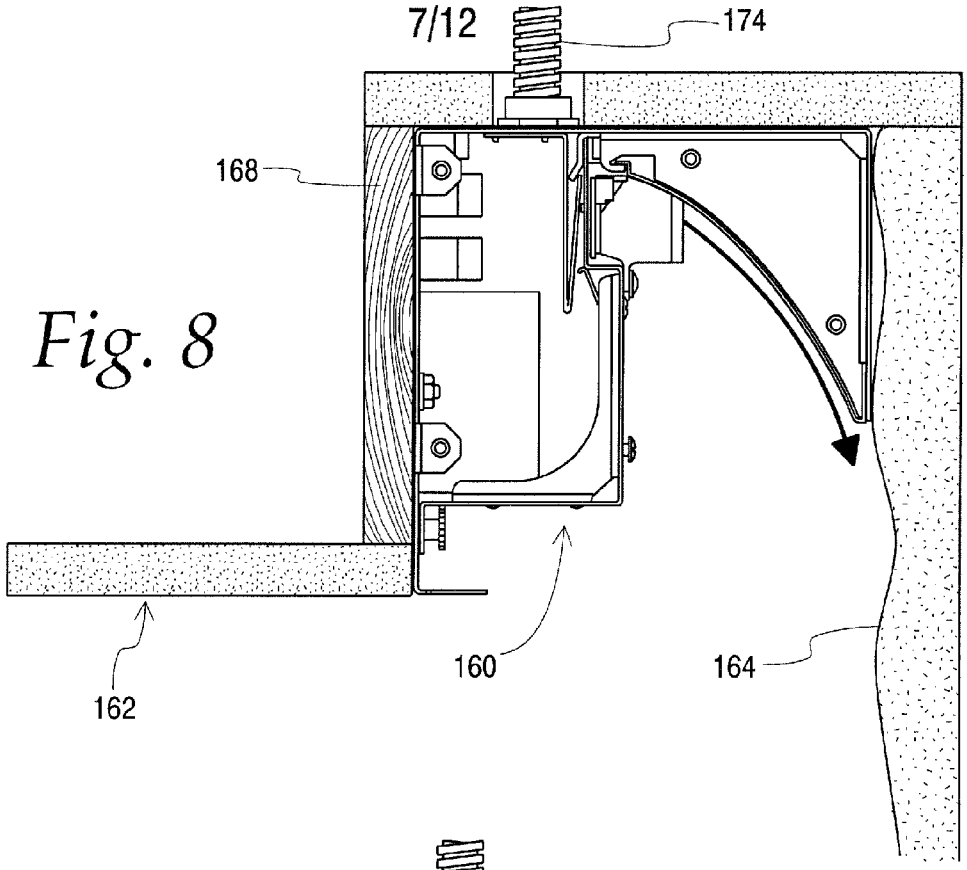
FIG. 8 is a side cross-sectional view of the fixture of FIG. 5 as mounted in a cove in the ceiling by a wall.
Figure 9:
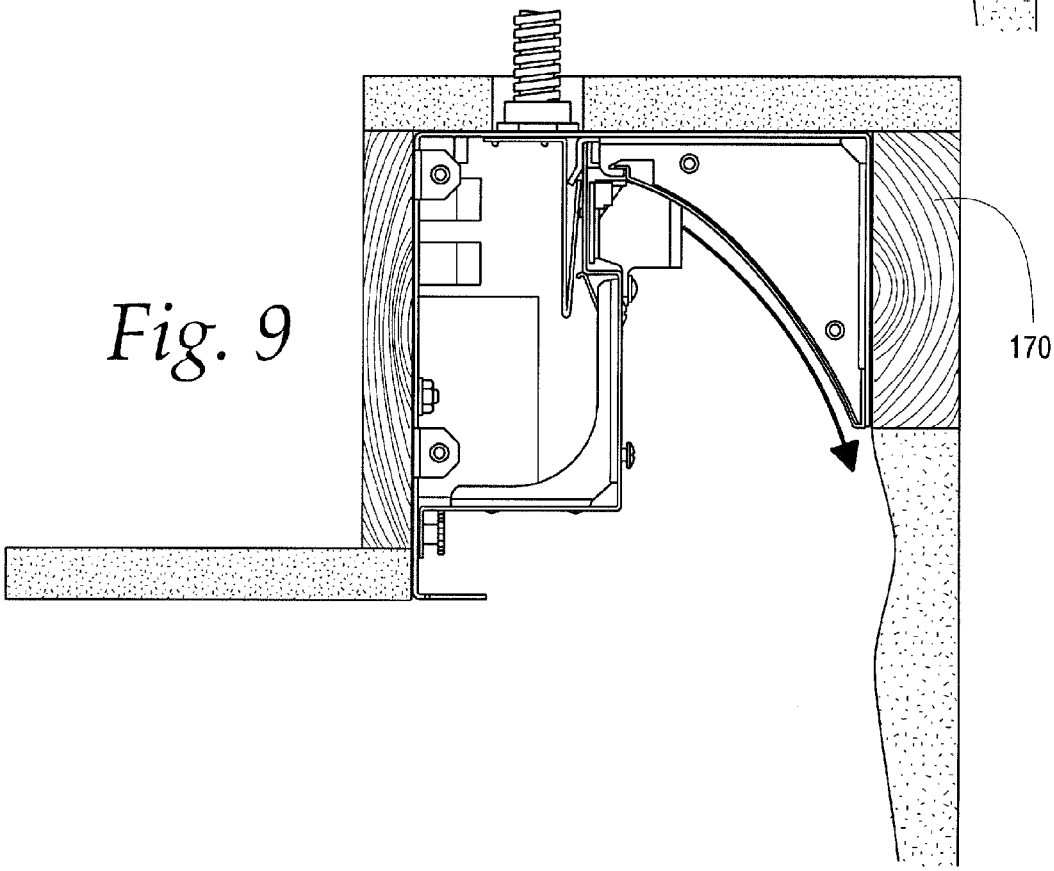
FIG. 9 is a view similar to FIG. 8 showing a different cove installation.
Figures 10, 11:
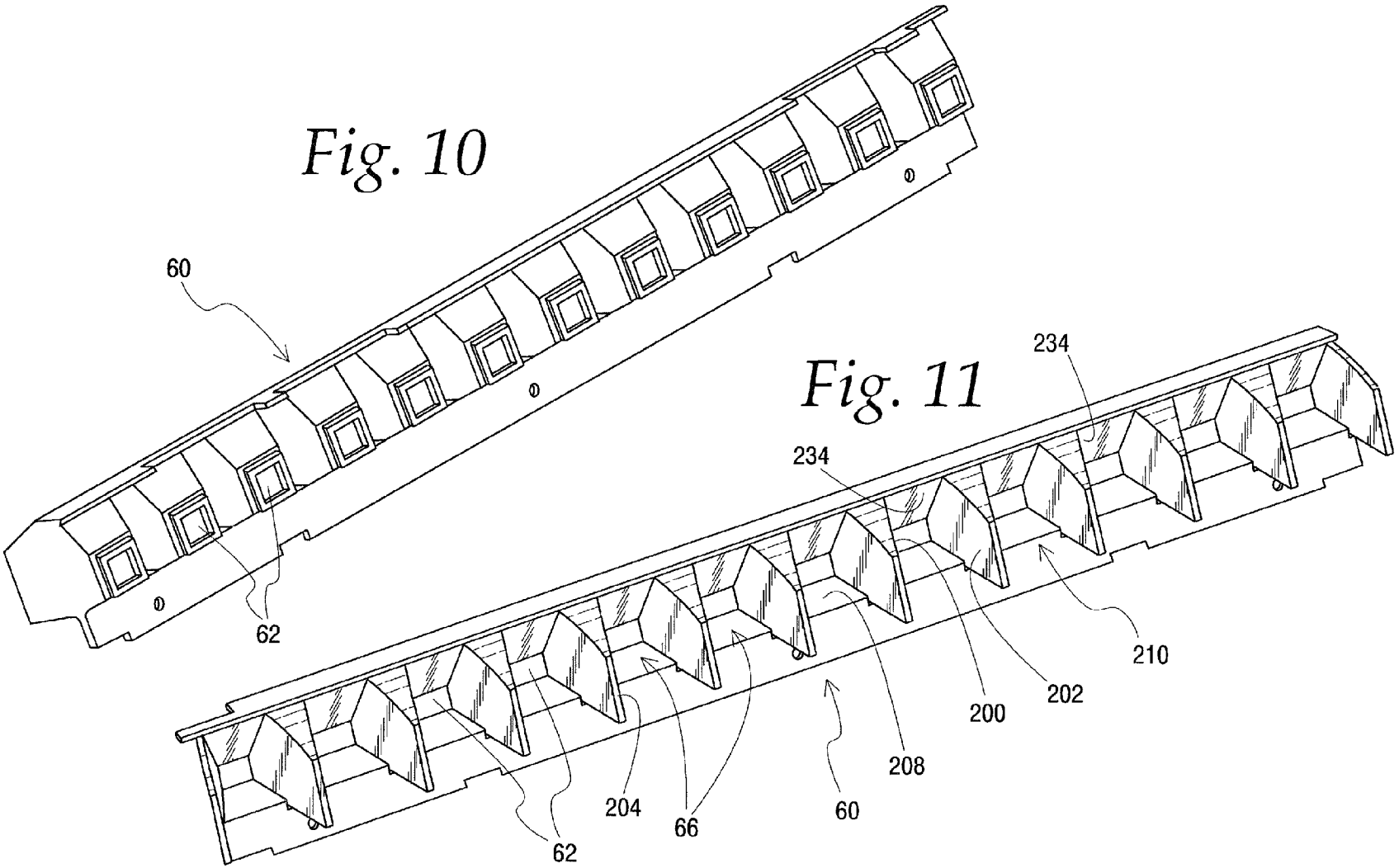
FIG. 10 is a perspective view of the back of a linear extending reflector usable in light fixtures according to the present invention.
FIG. 11 is a perspective view of the form of the reflector of FIG. 10.
Figure 12:
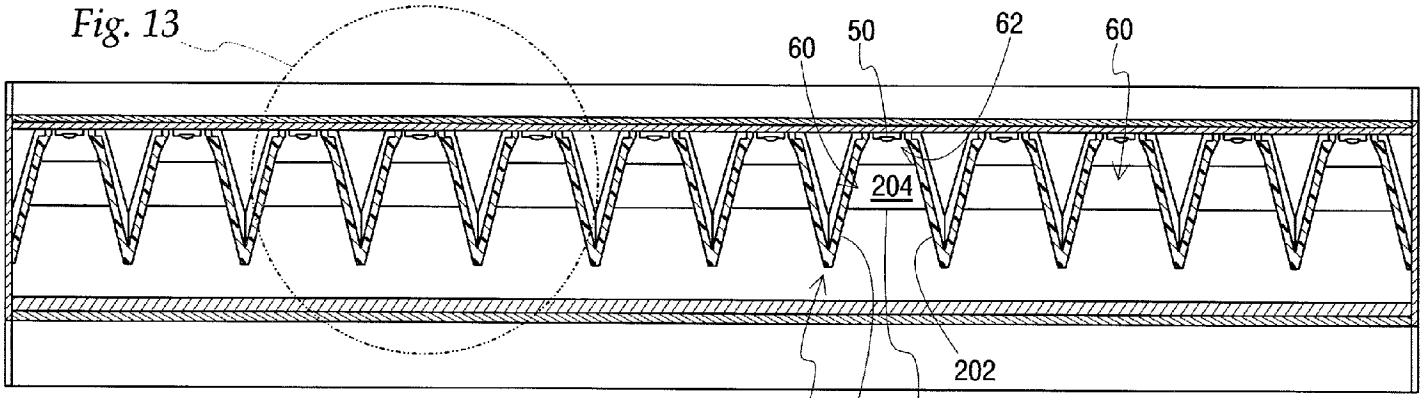
FIG. 12 is a cross-sectional view taken along line 12-12 of FIG. 1, showing the linear extending reflector.

As illustrated in FIG. 7, the light fixture 120 may be oriented at the bottom of a surface, with its horizontal wall 124 oriented at the bottom, to direct light upward, or, as illustrated in FIGS. 6, 8 and 9, may be oriented at the top of a surface, with its horizontal wall 124 oriented at the top, to direct light down. Of course, it should be appreciated that light fixtures embodying at least some aspects of the present invention can be used to highlight surfaces disposed at any orientation, including horizontal surfaces (e.g., ceilings and/or floors) and surfaces which are neither horizontal nor vertical, by orienting the fixture appropriately.

Moreover, as illustrated in FIGS. 8-9, the fixture 120 may be secured in a recess or cove 160 (e.g., in the ceiling at the top of a wall 164) to more effectively hide the fixture from view where desired. As illustrated in FIG. 8, the fixture 120 may, for example, be suitably secured by bolting the vertical wall 128 of the electrical component chamber 130 to a rigid member 168 spaced from but generally parallel to the wall 164 to be lighted, such spacing being substantially the same as the width of the fixture 120 whereby the edge of the parabolic reflector 146 is substantially aligned with the wall 164. If for any reason the wall 164 does not extend sufficiently into the cove 160 (e.g., as likely would be common in retrofit applications), an additional wall member 170 may advantageously be added, as illustrated in FIG. 9, to define and reinforce the cove 160 and the mounting of the fixture 120 therein. A flexible metallic tubing 174 may also be provided, for example, for electrical wiring.

As best illustrated in FIGS. 8-9, to use fixtures according to the present invention, the LEDs may be oriented to emit their light in a cone in which the central axis is directed toward, and substantially perpendicular to, the orientation of the surface to be lighted. As described in greater detail below, the second, linear, reflector 60 (and 150) function to retain the light cone of each LED with minimal loss of lighting while also directing the light suitably to the first, parabolic, reflector 146 (and 36) whereby a substantial amount of the light emitted by the LEDs is directed in narrow cones (e.g., in an eight to ten degree wedge viewed in a plane perpendicular to the wall being lighted), with excellent lateral spread to provide even lighting without scalloping.

The second, linear, reflector is illustrated and further explained in FIGS. 10-17. It should be appreciated that while reference numeral 60 (of the FIGS. 1-4 embodiment) will be used in the below description, what is described below is equally applicable to the linear reflector 150 of the FIGS. 5-9 embodiment.

As previously noted, the linearly extending second reflector 60 includes openings 62 spaced to align with the spaced LEDs of the fixture, and also defines a plurality of reflecting enclosures 66 associated with the openings 62 (and LEDs).

Each enclosure 66 includes first and second generally flat surfaces 200, 202 which are substantially symmetrical on opposite sides of a plane which includes the light cone central axis of the associated LED and is perpendicular to the linear direction of the reflector 60. The first and second surfaces 200, 202 of adjacent enclosures 66 generally intersect in a "V" 204. Further, the first and second surfaces 200, 202 also cooperate to ensure that the lateral spread light from the spaced LEDs will be substantially even without undesirable scalloping.

Each enclosure 66 also includes a third generally flat surface 208 extending in the linear direction and intersecting both of the first and second surfaces 200, 202. Further, either the lip 210 of the third generally flat surface 208 or the linear lip 82 of the reinforcing strip 76 (see FIG. 3) is positioned between the LED and the outer lip of the first, parabolic, reflector 36 to ensure that direct light does not undesirably leak from the fixture (e.g., note rays 230*a*, 230*b* in FIGS. 3 and 6).

Additionally, a fourth generally flat surface 234 extends in the linear direction and intersecting both of the first and second surfaces 200, 200, with the third and fourth surfaces 208, 234 cooperating to direct substantially all light from the enclosure to the first, parabolic, reflector 36, thereby minimizing lost light, and also facilitating the direction of light to the first reflector 36 whereby the beams of light from all the LEDs exiting the fixture will be in a narrow wedge shape as previously described.

Advantageously, the linearly extending second reflector 60, and in particular its four described surfaces 200, 202, 208, 234 may be made of, or coated by, a suitable reflective material to maximize light output and minimize light loss. For example, the second reflector 60 may be made of, or coated by, a highly reflective matte white material.

Figure 13:
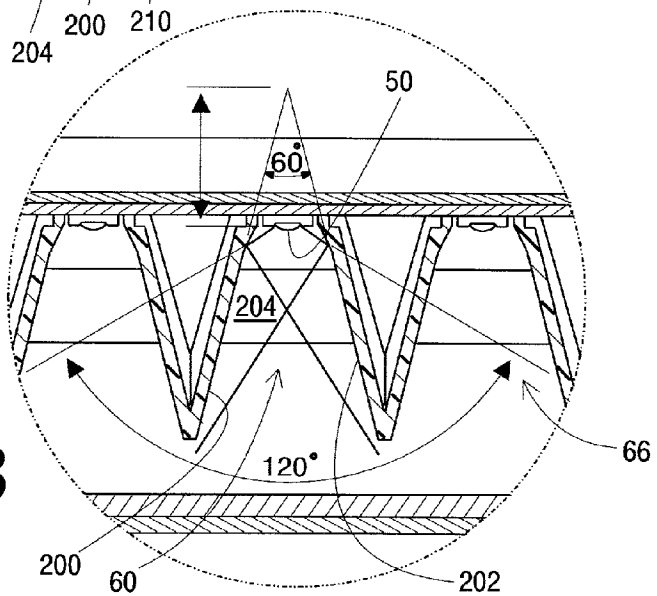
FIG. 13 is an enlarged view of the highlighted portion of FIG. 12.

FIG. 13 generally illustrates in enlarged form how the 60 degree orientation between the first and second surfaces 200, 202 of the enclosures 66 facilitates in narrowing the 120 degree conical beam of light emitted from each LED 50.

Figure 15:
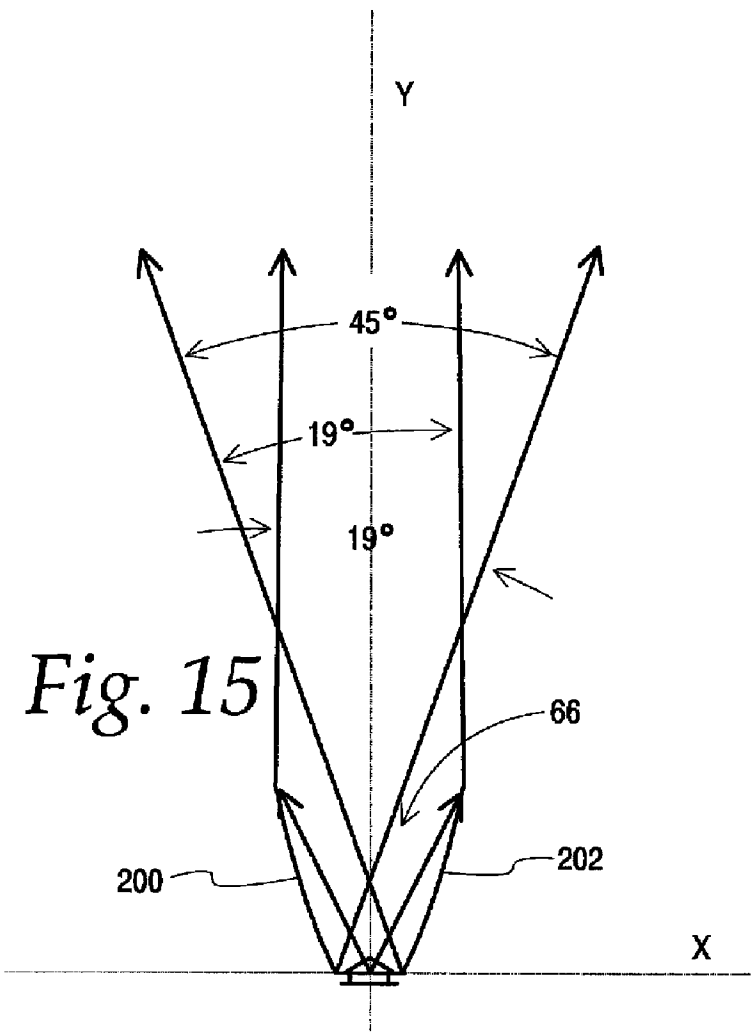
FIG. 15 is a light ray diagram like FIG. 14, showing reflected light.
Figure 14:
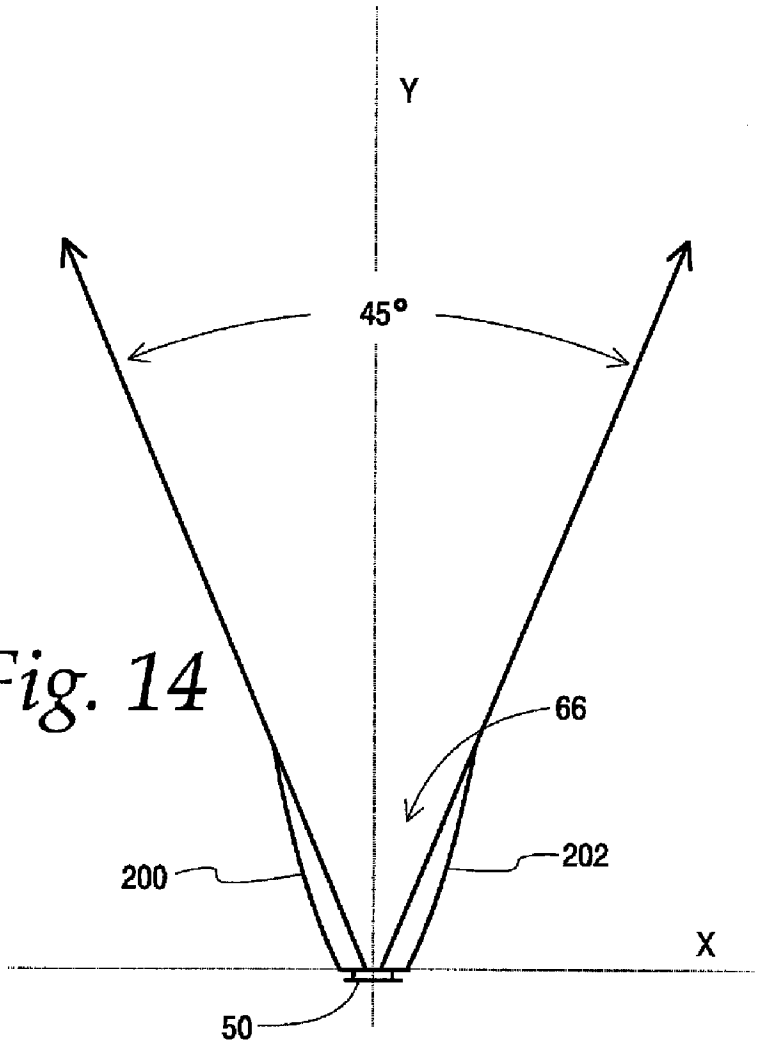
FIG. 14 is a light ray diagram illustrating the coverage of direct light exiting the linear extending reflector in a horizontal plane.

FIGS. 14-15 similarly illustrate the lateral spread of the light exiting an enclosure (the lateral or linear direction of the second reflector 60 being the x-axis, which is typically horizontal and parallel to the wall being lighted in wall grazing applications). The y-axis is perpendicular to the x-axis and to the wall, and also typically lies in a horizontal plane in wall grazing applications.

As illustrated in FIG. 14 (which also illustrates that the surfaces 200, 202 may have some curvature though being generally flat), direct light from an LED can generally be restricted to less than about 45 degrees (or 22½ degrees on opposite sides of the y-axis. Further, as illustrated in FIG. 15, reflected light exiting the enclosure 66 can be distributed between a substantially straight, centered beam (for light from the center of the LED reflecting off the far edges of the walls 200, 202), to a wedged reflected light spread of, for example, about 39 degrees centered on the y-axis (for light from opposite sides of the LED 50 and reflecting off the immediately adjacent walls 200, 202).

Figure 17:
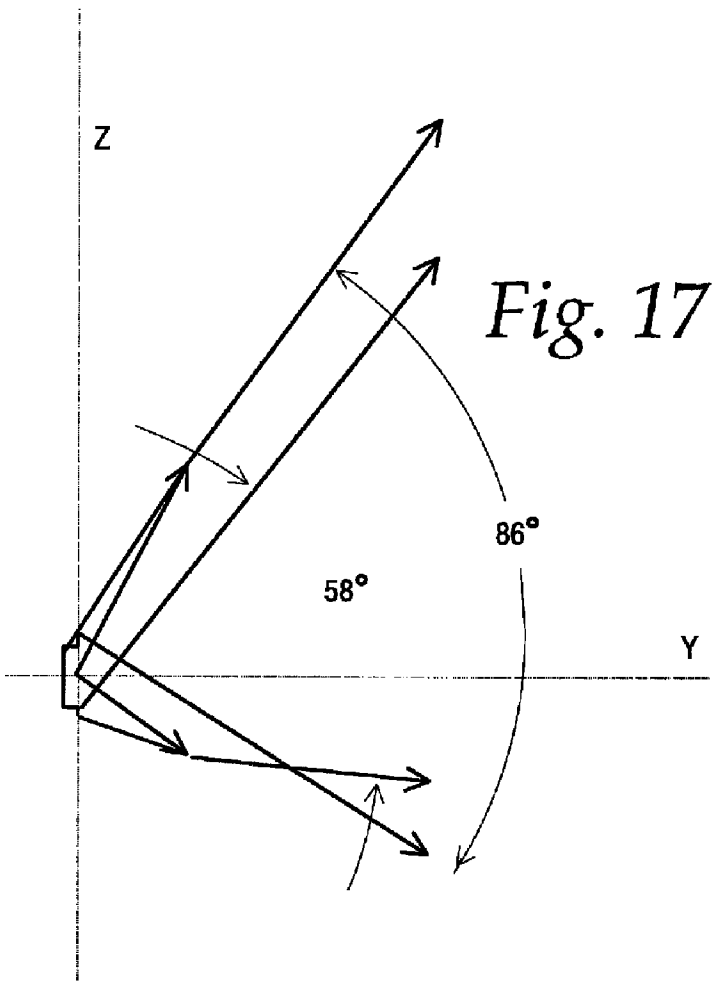
FIG. 17 is a light ray diagram like FIG. 16, showing reflected light.
Figure 16:
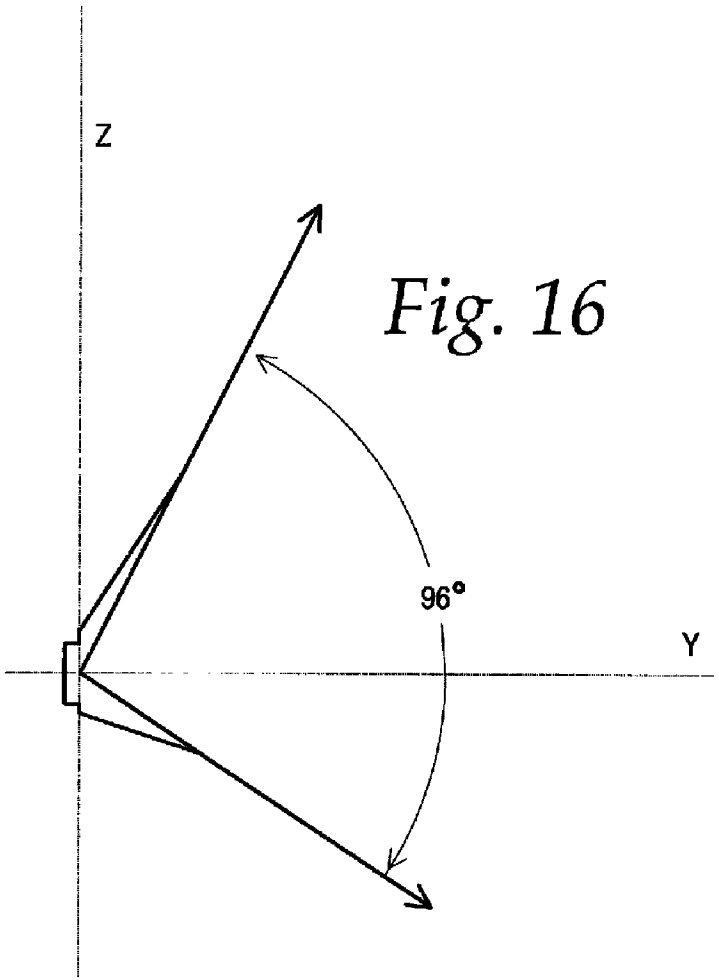
FIG. 16 is a light ray diagram illustrating the coverage of direct light exiting the linear extending reflector in a vertical plane.

FIGS. 16-17 are similar to FIGS. 14-15, but they illustrate the vertical (when oriented to light a vertical wall for wall grazing, for example) spread of the light exiting the enclosure 66, where the z-axis is vertical and, as noted with respect to FIGS. 14-15, the y-axis is perpendicular to the x-axis and to the wall, and also typically lies in a horizontal plane. As illustrated in FIG. 16, direct light from the LED can generally be restricted through, for example, 96 degrees, asymmetric relative to the y-axis. Further, as illustrated in FIG. 17, reflected light exiting the enclosure 66 can be distributed across a similar spread.

Figure 18:
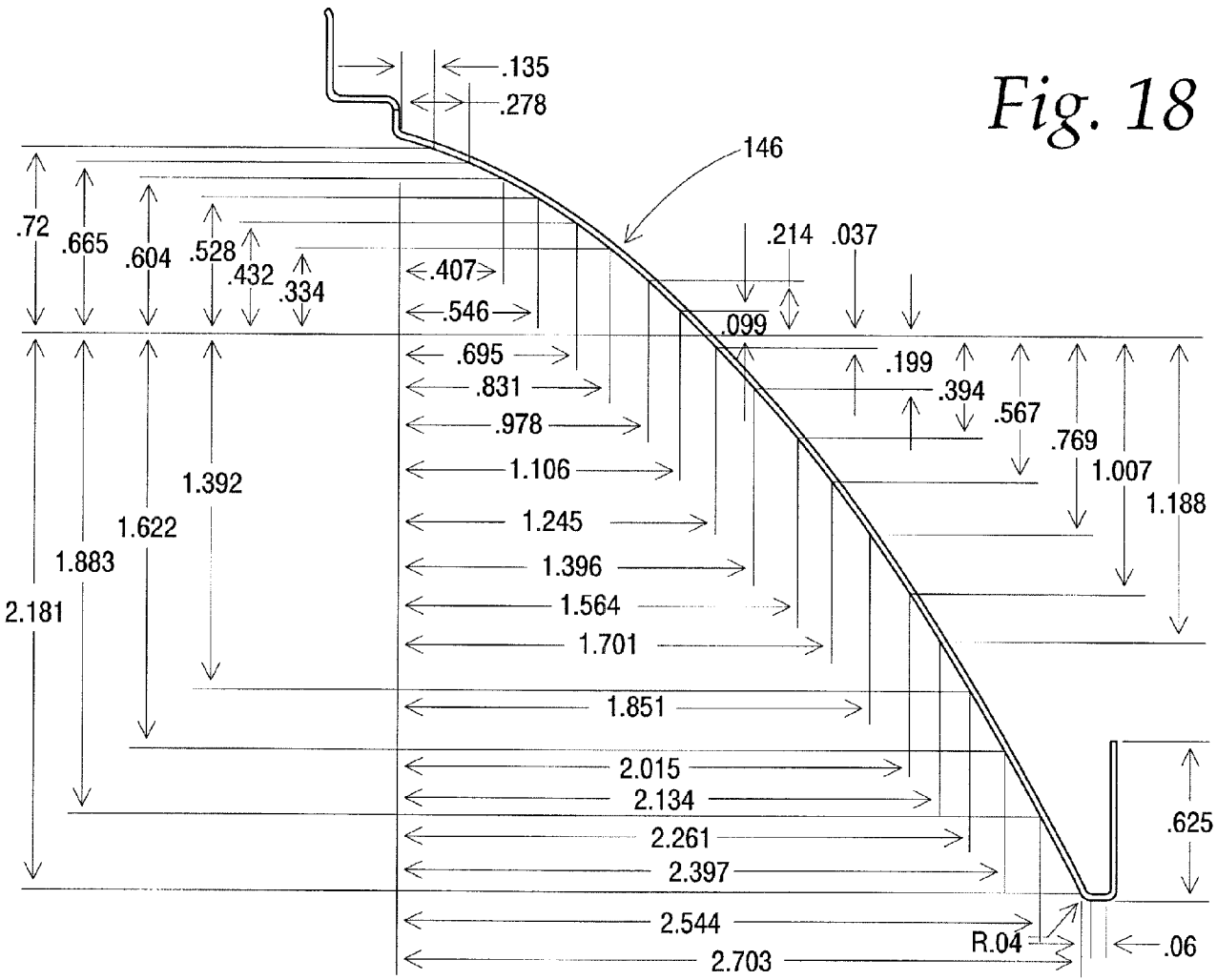
FIG. 18 is a side view of the generally parabolic reflector illustrating an advantageous curvature.

Of course, as previously noted, substantially all of the light exiting the enclosures 66 will then strike the first reflector 36 to be directed as desired to substantially uniformly graze the wall. FIG. 18 illustrates in detail a particular shape of the reflector 36 which may be advantageously used with the present invention, with connecting edges adapted for use with the second described (FIGS. 5-9) embodiment. In addition to the lateral spread of the light beam, in wall grazing applications such as illustrated in FIG. 6, the light beam may be directed in a narrow spread (e.g., ten degrees in the FIG. 6 cross-section), whereas in other lighting applications (e.g., wall washing), the light spread in the cross-section perpendicular to the wall may be greater (as illustrated in FIG. 3).

In short, it should be appreciated that the second reflector 60 of the present invention will enable a wide 120 degree conical light emitting from LEDs 50 to be narrowed into a narrower shape in which the light will be focused, directed and evenly spread (without scalloping) as is desired in, for example, wall grazing applications. Moreover, it should be appreciated that it is within the broad scope of the present invention to provide a fixture with a single LED and associated first and second reflectors as described which may be used to efficiently control the exiting beam of the light. For example, the light may be controlled to be in a 10×60 degree beam (i.e., having a sixty degree lateral spread and a ten degree spread perpendicular to the wall) in wall grazing applications wherein light is advantageously grazed over surfaces to highlight textures and features of the surface. Of course, when multiple LEDs are used together, the lateral spread (e.g., sixty degrees) may be advantageously used to provide a wide swath of a light beam without scalloping undesirably highlighting that there are multiple sources of the light or otherwise providing an undesirably non-uniform lighting of the wall.

The invention described herein provides a different approach to lighting, particularly to grazing a wall with light from LEDs. The LEDs direct their light into the reflector, basically perpendicular to the LED axis of distribution, which reflects the light in a tight beam parallel with the wall. Close spacing and no direct light from the LED's allows the wall to be grazed without a scallop effect and without a large contrast in light levels as seen on state of the art solutions. To improve lateral control and intensify the light directed parallel to the wall, the second reflector is provided to essentially provide an asymmetric reflector around each LED, with the individual reflectors tightening the lateral distribution (e.g., from 120 degrees to about 60 degrees).

The result of these reflectors is that the upper portion of the reflected light (in FIG. 17) has only a minimal portion of the light reflected by the individual reflector, with the lower portion of the reflected light (in FIG. 17) being reflected towards the linear reflector which controls the vertical distribution. The result of the reflector combination is that a significant portion (greater than 80 percent, for example) of the light may be distributed parallel to the wall within about an eight degree beam. For example, when the light impinges at 30 degrees from beam center, it reflects away from the LED source, whereby fixtures according to the present invention provide light which more efficiently grazes a wall for longer distances than any of the previously mentioned solutions. The end benefit is more uniform light over greater distances with less energy than HID or fluorescent.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A light fixture for lighting a wall, comprising:

a supporting base;

at least one light emitting diode (LED) on the base emitting light in a cone having a central axis;

a first reflector curved between a first lip secured to said base adjacent said LED and a second lip spaced from said base, with said central axis of said cone intersecting said first reflector between said first and second lips;

a second reflector defining a reflecting enclosure for said LED, at least said reflecting enclosure including first and second generally flat surfaces on opposite sides of the LED and substantially symmetrical about a plane which includes the light cone central axis of the LED, and a third generally flat surface extending in a linear direction of said second reflector and intersecting both of said first and second surfaces;

whereby said first reflector is oriented to reflect light from both said LED and said second reflector in a beam having a selected shape.

2. The light fixture of claim 1, wherein said base is adapted for mounting relative to a wall whereby said beam is directed at the wall to provide selected lighting of said wall.

3. The light fixture of claim 1, wherein the surfaces of said second reflector are highly reflective matte white.

4. The light fixture of claim 1, wherein said first and second surfaces of said second reflector include upper edges restricting direct light of said light cones escaping said enclosures to less than about 45 degrees on either side of said central axes in said plane which includes the light cone central axis of the LED.

5. The light fixture of claim 1, wherein said curved first reflector is generally parabolic to direct light from the fixture in a beam having a spread of less than about 10 degrees in a plane perpendicular to the linear direction.

6. The light fixture of claim 1, wherein said light enclosure further includes a fourth generally flat surface on the opposite side of said axis from said third surface and intersecting both of said first and second surfaces, said third and fourth generally flat surfaces cooperating to direct light asymmetrically relative to said cone axes from said enclosures to said first reflector.

7. The light fixture of claim 6, wherein said curved first reflector is generally parabolic to direct light from the fixture in a beam having a spread of less than about 10 degrees in a plane perpendicular to the linear direction.

8. A light fixture for lighting a wall, comprising:

a supporting base adapted to mount adjacent the wall;

a plurality of substantially linearly aligned light emitting diodes (LEDs) on the base, each LED emitting light in a cone, said base adapted to be mounted whereby each of said cones has a central axis oriented substantially perpendicular to the wall;

a linearly extending first reflector, wherein said first reflector is curved between a first linear lip secured to said base adjacent said LEDs and a second lip spaced from said base, with said central axes of said cones intersecting said first reflector between said first and second lips;

a linearly extending second reflector defining a plurality of reflecting enclosures with each of said LEDs in separate reflecting enclosures, each reflecting enclosure including first and second generally flat surfaces on opposite sides of the LED and substantially symmetrical about a linear plane which includes the light cone central axis of the associated LED and is perpendicular to the linear direction, and a third generally flat surface extending in a linear direction of said second reflector and intersecting both of said first and second surfaces;

whereby said first reflector is oriented to reflect light from said LEDS and said second reflector in a substantially narrow beam along the linear direction of the second reflector.

9. The light fixture of claim 8, wherein said base is adapted for mounting to the wall with the second lip adjacent the wall.

10. The light fixture of claim 8, wherein said first reflector is glossy metal.

11. The light fixture of claim 8, wherein the surfaces of said second reflector are highly reflective matte white.

12. The light fixture of claim 8, wherein said first and second surfaces of said second reflector include upper edges restricting direct light of said light cones escaping said enclosures to less than about 45 degrees on either side of said central axes in said linear plane.

13. The light fixture of claim 8, wherein said first and second surfaces of said second reflector include upper edges restricting direct light of said light cones escaping said enclosures to less than about 45 degrees on either side of said central axes in said linear plane.

14. The light fixture of claim 8, wherein said base includes an electrical enclosure.

15. The light fixture of claim 8, wherein said curved first reflector is generally parabolic to direct light from the fixture in a beam having a 8 to 10 degree spread, said beam having a substantially uniform spread across the linear direction.

16. The light fixture of claim 8, wherein said light enclosures each further comprise a fourth generally flat surface extending in said linear direction and intersecting both of said first and second surfaces, said third and fourth generally flat surfaces cooperating to direct light asymmetrically relative to said cone axes from said enclosures to said first reflector.

17. A light fixture for providing light to graze a wall, comprising:

a supporting base adapted to mount adjacent the wall;

a plurality of substantially linearly aligned light emitting diodes (LEDs) on the base, each LED emitting light in a cone, each of said cones having a central axis oriented substantially perpendicular to the wall when said base is mounted adjacent the wall;

a linearly extending first reflector, wherein said first reflector is substantially parabolic between a first linear lip secured to said base adjacent said LEDs and a second lip spaced from said base, with said central axes of said cones intersecting said first reflector between said first and second lips, and said first reflector adjacent said second lip is oriented with its surface generally parallel to the wall when said base is mounted adjacent the wall;

a linearly extending second reflector defining a plurality of reflecting enclosures with each of said LEDs in separate reflecting enclosures, each reflecting enclosure including first and second generally flat surfaces on opposite sides of the LED and substantially symmetrical about a linear plane which includes the light cone central axis of the associated LED and is perpendicular to the linear direction, and a third generally flat surface extending in a linear direction of said second reflector and intersecting both of said first and second surfaces;

whereby said first reflector is oriented to reflect light from said LEDS and said second reflector in a direction which substantially grazes the wall.

18. The light fixture of claim 17, wherein said base is adapted for mounting to the wall with the second lip adjacent the wall.

19. The light fixture of claim 17, wherein said first reflector is glossy metal.

20. The light fixture of claim 17, wherein the surfaces of said second reflector are highly reflective matte white.

21. The light fixture of claim 17, wherein said first and second surfaces of said second reflector include upper edges restricting direct light of said light cones escaping said enclosures to less than about 45 degrees on either side of said central axes in said linear plane.

22. The light fixture of claim 17, wherein said base includes an electrical enclosure.

23. The light fixture of claim 17, wherein said parabolic surface of said first reflector directs light from the fixture in a beam having a 8 to 10 degree spread in a direction generally along the wall surface, said beam having a substantially uniform spread across the linear direction.

24. The light fixture of claim 17, wherein said light enclosures each further comprise a fourth generally flat surface extending in said linear direction and intersecting both of said first and second surfaces, said third and fourth flat surfaces cooperating to direct light asymmetrically from said enclosures to said first reflector.

* * * * *